US006305197B1

(12) United States Patent
Ling

(10) Patent No.: US 6,305,197 B1
(45) Date of Patent: Oct. 23, 2001

(54) CABLE COMBINATION LOCK

(76) Inventor: Chong-Kuan Ling, 11F, No. 27, An-Ho Road, Sec. 1, Taipei, 106 (TW)

( * ) Notice: Subject to any disclaimer, the term of this patent is extended or adjusted under 35 U.S.C. 154(b) by 0 days.

(21) Appl. No.: 09/483,730

(22) Filed: Jan. 14, 2000

(51) Int. Cl.[7] ..... E05B 37/06; E05B 37/10; E05B 37/14; E05B 37/18; E05B 37/22

(52) U.S. Cl. ..... 70/30; 70/58

(58) Field of Search ..... 70/18, 30, 58, 70/316, 312

(56) References Cited

U.S. PATENT DOCUMENTS 3,518,853 * 7/1970 Bolte ..... 70/58
3,625,031 * 12/1971 Alley, III ..... 70/58
4,308,733 * 1/1982 Tampa ..... 70/259
4,733,840 * 3/1988 D'Amore ..... 248/205.3
5,579,657 * 12/1996 Makous ..... 70/15
5,749,251 * 5/1998 Keefe ..... 70/30
5,791,171 * 8/1998 Kelley ..... 70/58
6,058,744 * 5/2000 Ling ..... 70/28
6,227,016 * 5/2001 Yu ..... 70/30

* cited by examiner

*Primary Examiner*—Lynne H. Browne
*Assistant Examiner*—John B. Walsh

(57) ABSTRACT

A cable combination lock includes: a lock body (1) having a plurality of dials and sleeves rotatably mounted in the lock body, a locking bolt (2) insertable and lockable in the lock body (1), a cable (3) having a first cable end (31) secured with the locking bolt (2) and a second cable end (32) formed as a cable ring (33), and at least a fastener (4) secured on a portable computer or the other object to be locked; whereby upon insertion of the locking bolt (2) through the fastener (4) and through the cable ring (33) of the cable (3) to be locked in the lock body (1), and upon fastening of the cable (3) on a fixture, the computer or the object will be safely locked and fastened to the fixture.

10 Claims, 7 Drawing Sheets

CABLE COMBINATION LOCK

BACKGROUND OF THE INVENTION

A conventional anti-theft device for small portable equipment may require a padlock for locking one end portion of a security cable, which is connected to the portable equipment, to a fixture. For unlocking the lock, a key should be always prepared or getting ready for unlocking purpose. Once losing the key, it will be impossible to unlock the lock.

The present inventor has found the drawbacks of the conventional anti-theft device and invented the present cable combination lock.

SUMMARY OF THE INVENTION

The object of the present invention is to provide a cable combination lock including: a lock body (1) having a plurality of dials and sleeves rotatably mounted in the lock body (1), a locking bolt (2) insertable and lockable in the lock body (1), a cable (3) having a first cable end (31) secured with the locking bolt (2) and a second cable end (32) formed as a cable ring (33), and at least a fastener (4) secured on a portable computer or the other object to be locked; whereby upon insertion of the locking bolt (2) through the fastener (4) and through the cable ring (33) of the cable (3) to be locked in the lock body (1), and upon fastening of the cable (3) on a fixture, the computer or the object will be safely locked and fastened to the fixture.

DETAILED DESCRIPTION

Figure 1:
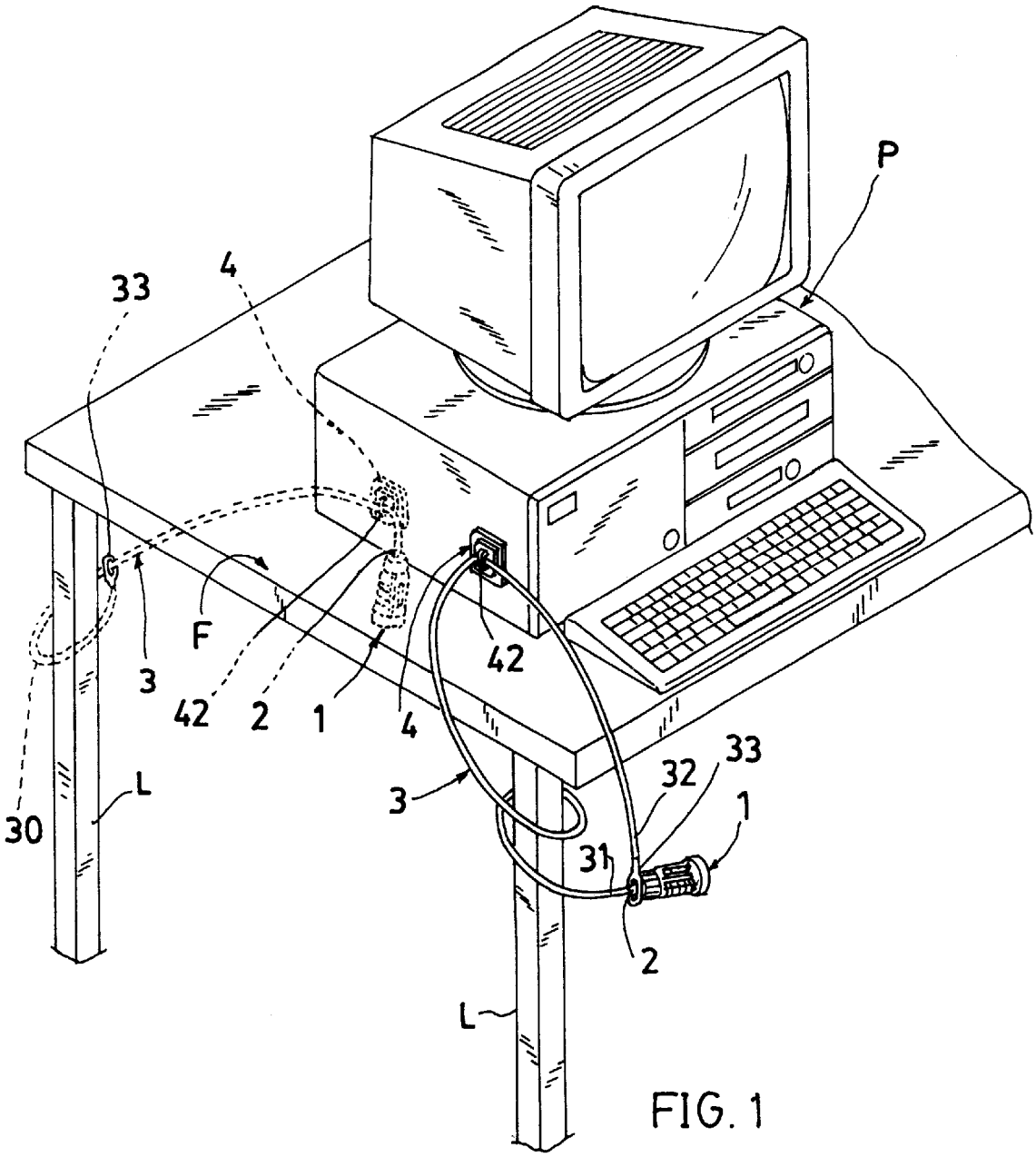
FIG. 1 is a perspective view of the present invention for locking a portable computer.

As shown in the drawing figures, the present invention comprises: a lock body 1, a locking bolt 2 insertable and lockable in the lock body 1, a cable 3 having a first cable end 31 secured with the locking bolt 2 and having a second cable end 32 formed as a cable ring 33; and at least a fastener 4 fixed on an object P to be locked or fixed on a fixture F.

The fastener 4 includes: a base 41 which is fixed on the object P to be locked by adhesive or by other joining methods, and a staple portion 42 formed with a locking aperture or a closed U shaped member on the base 41 for passing the cable 3, the locking bolt 2 and the cable ring 33 through the staple portion 42, but precluding the insertion of the lock body 1 into the aperture in the staple portion 42.

The object P to be locked may refer to a personal computer, a portable computer, an information processing apparatus, or any other precious equipments to be locked. The fixture F may be a fixed furniture, building, architecture, or heavy installation difficultly movable or deadly fixed on a ground or floor surface.

The lock body 1 includes: a housing 11 which may be formed as a cylindrical shape or any other shapes; a hollow spindle 12 protruding from a bottom portion la of the housing 11 towards a free end plate 1*b* of the housing 11; a plurality of dials 14 and sleeves 13 rotatably mounted in the housing 11, with each sleeve 13 engaged with each dial 14 and rotatably mounted on the hollow spindle 12, each sleeve 13 rotatably resiliently coupled with each sensing plate 134 formed on the hollow spindle 12 for sensing the dialing operation; a tension spring 15 retained on the bottom portion 1*a* of the housing 11 for resiliently urging the sleeves 13 to be engaged with the dials 14 towards a retaining plate 17 retained at the free end plate 1*b* of the housing 11; a thrusting disk 16 formed between the retaining plate 17 and an outermost sleeve 13 positioned adjacent to the free end plate 1*b* for changing the combination for the present invention; and a cover 10 covering the free end plate 1*b* of the housing 11.

Figure 3:
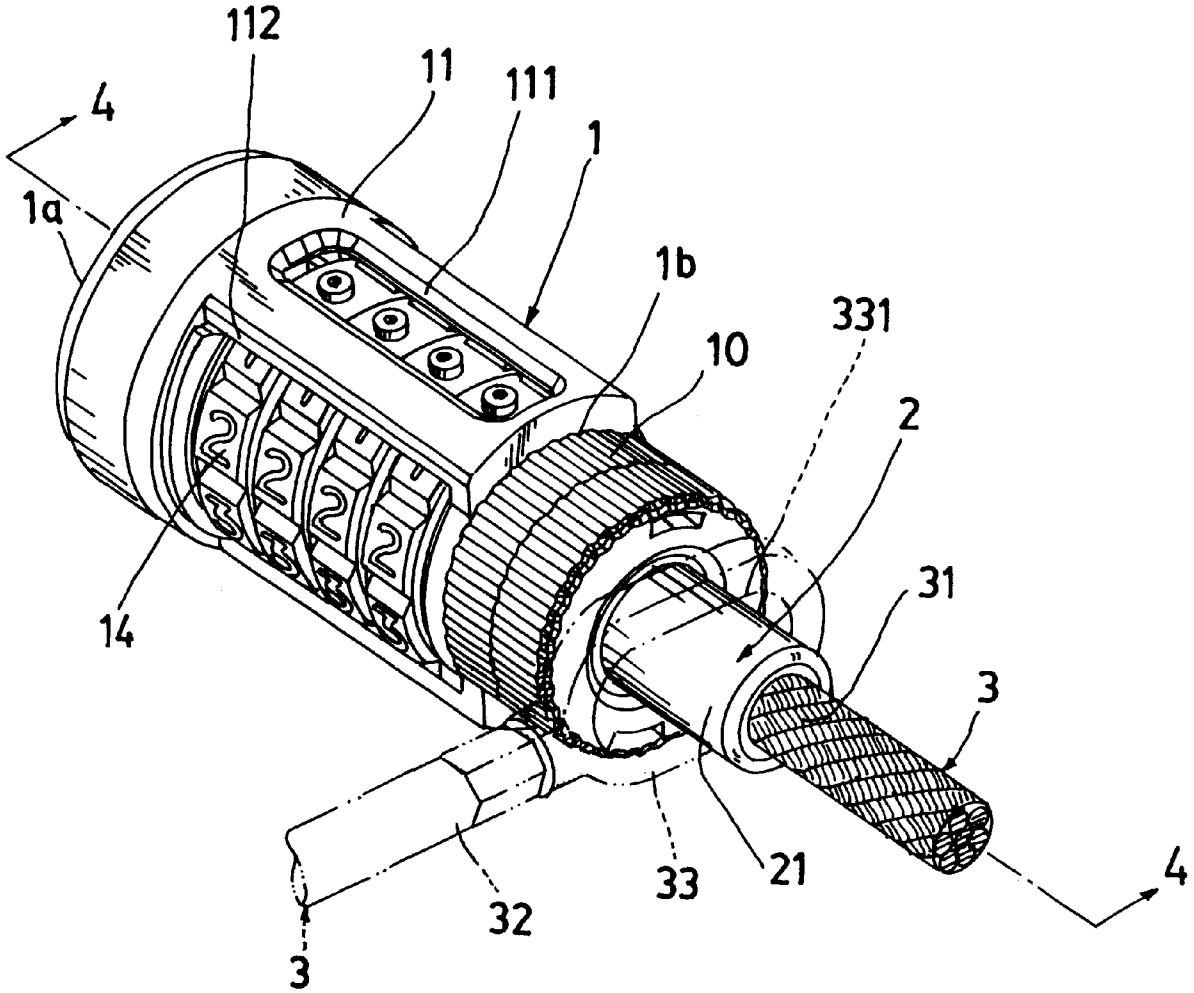
FIG. 3 shows the lock body locked with the locking bolt of the present invention.

The housing 11 is formed with a display window 111 longitudinally in the housing 11 for reading the combination of the dials 14 as shown in FIG. 3; and also formed with two dialing windows 112 disposed on opposite sides of the housing for protruding the dials 14 sidewardly to be dialed by the user through such dialing windows 112.

The hollow spindle 12 is formed with a central hole 121 longitudinally in the spindle 12 for inserting the locking bolt 2 into the central hole 121, with the central hole 121 communicated with an outer bolt hole 101 formed in the cover 10 allowing an inward insertion of the locking bolt 2 through the outer bolt hole 101 into the central hole 121 when locking the bolt 2 in the lock body 1.

The lock body 1 is formed with at least a pair of hook portions 1*c* on the free end plate 1*b* of the housing 11 to be engaged with a recess 102 recessed in the cover 10 for securing the cover 10 on the end plate 1*b* of the lock body 1. The cover 10 has a diameter, width or area larger than that of a ring opening 331 in the cable ring 33, and also larger than that of a locking aperture in the staple portion 42 of the fastener 4.

Figure 4:
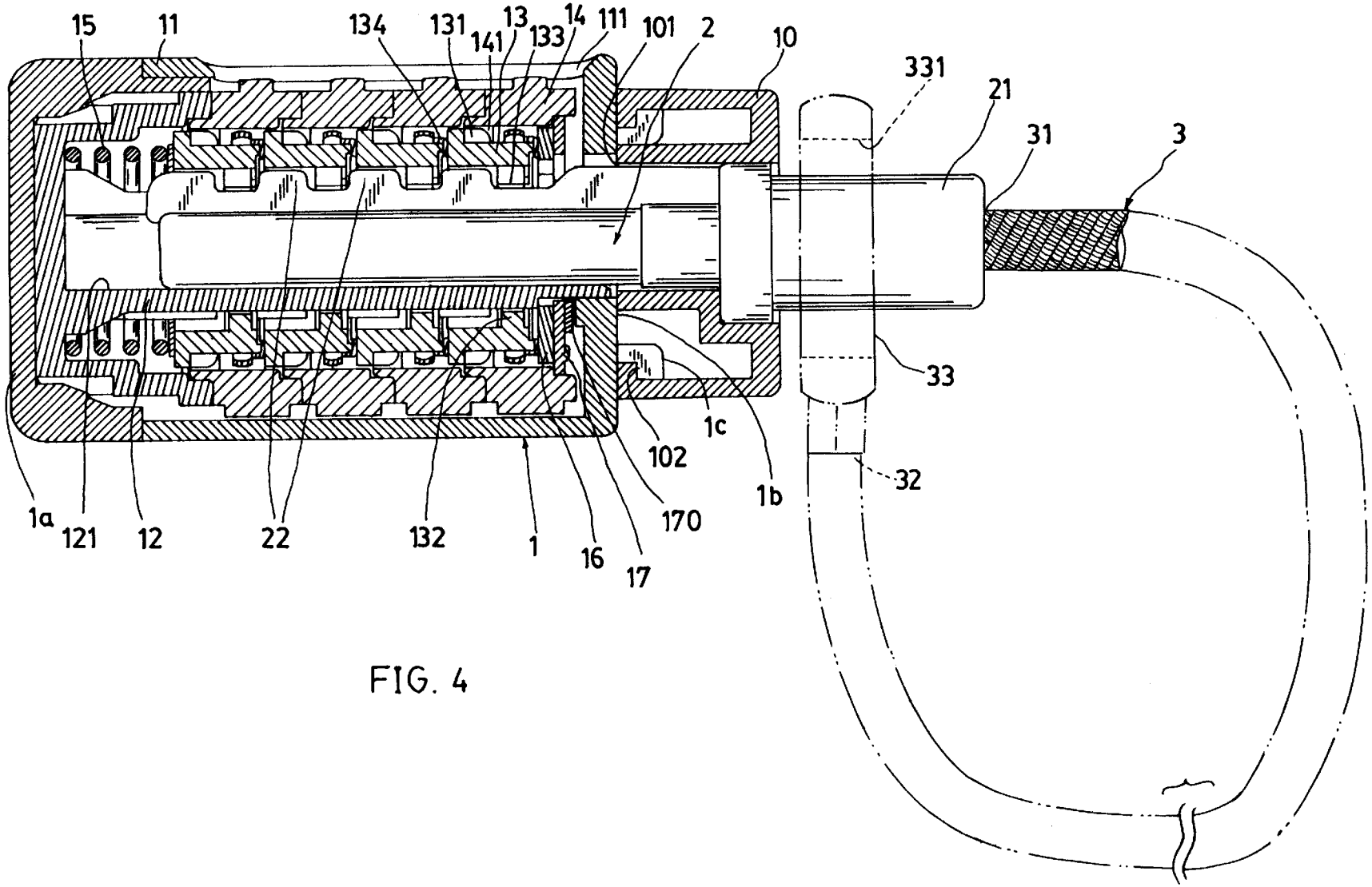
FIG. 4 is a longitudinal sectional drawing as viewed from 3—3 direction of FIG. 3.

Each sleeve 13 includes a plurality of protrusions 131 annularly formed on a perimeter of the sleeve 13 each protrusion 131 engageable with each recess 141 of a plurality of recesses 141 annularly formed in each dial 14 for a synchronous coupling rotation of each dial 14 with each sleeve 13, an annular retarding ring 132 annularly formed on an inside wall of each sleeve 13, a central sleeve hole formed through a central portion of each sleeve for rotatably engaging each sleeve 13 on the hollow spindle 12, a notch 133 longitudinally cut through the annular retarding ring 132 in the sleeve; whereby upon retaining of a projection 22 formed on the locking bolt 2 against the annular retarding ring 132 of the sleeve 13, the locking bolt 2 will be locked in the lock body 1 since the projection 22 of the bolt 2 is retarded against the annular retarding ring 132 of the sleeve 13 for preventing a retraction or withdrawal of the bolt 2 from the lock body 1; and upon a rotation of dials 14 and sleeves 13 to match with an unlocking combination of the present invention to engage the projection 22 of the locking bolt 2 with each notch 133 formed through the annular retarding ring 132 in each sleeve 13, thereby releasing the retarding of the projection 22 of the bolt 2 on the annular ring 132 of the sleeve 13 and allowing a withdrawal of the bolt 2 from the lock body 1 for unlocking the present invention (FIG. 4).

The locking bolt 2 has a plurality of projections 22 equally spaced and longitudinally formed on the bolt 2, with each projection 22 engageable on each annular retarding ring 132 formed in each sleeve 13 when the bolt 2 is locked in the lock body 1.

The locking bolt 2 further includes a handle portion 21 formed on an outer portion of the bolt 2 adjacent to the cover 10 of the lock body 1 to be held by a lock user for locking or unlocking the present invention.

Figure 2:
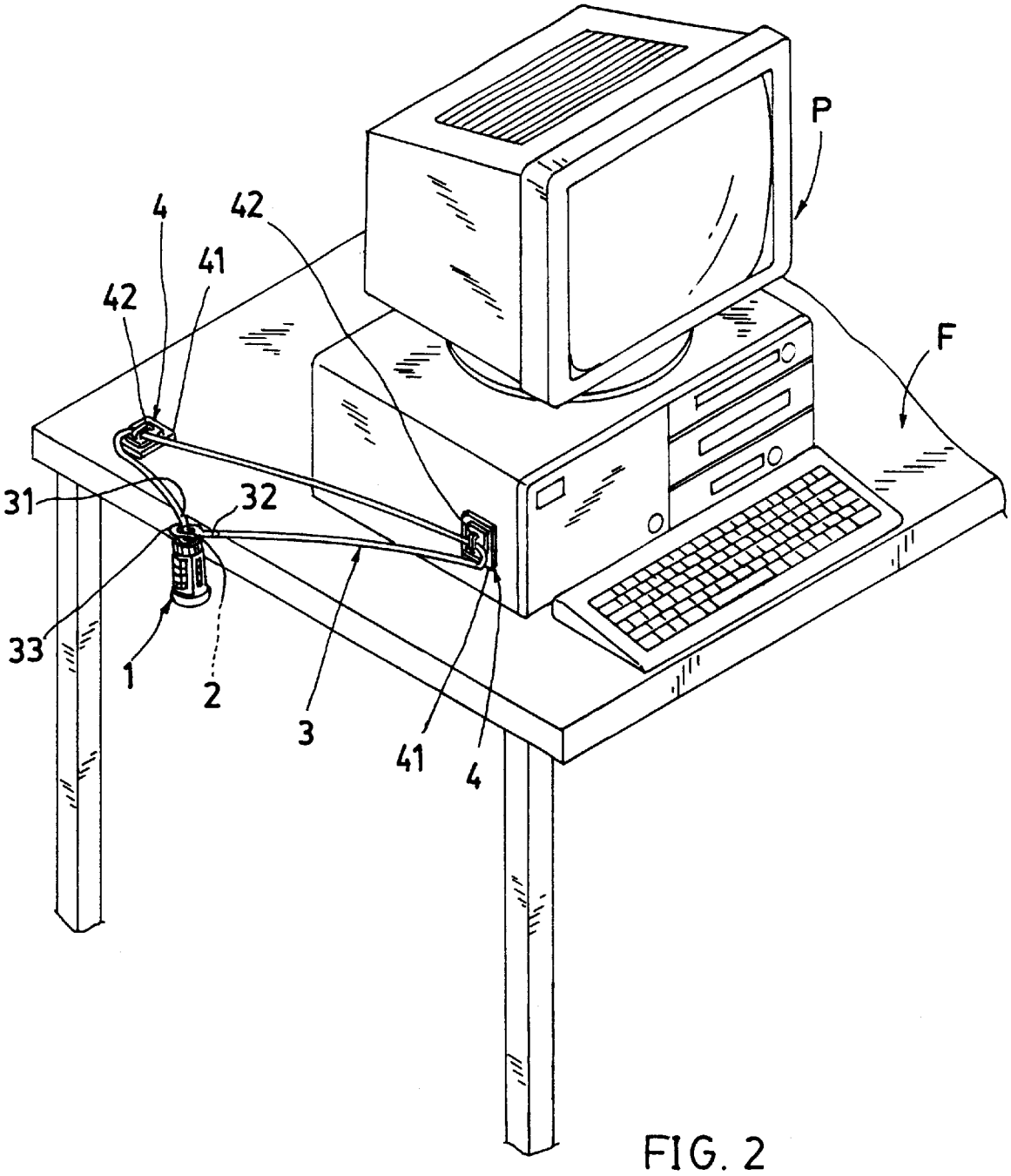
FIG. 2 is another perspective view of the present invention for locking the computer in a different way.

The locking bolt 2 may pass through the ring hole 331 formed in the cable ring 33. However, the lock body 1 can not pass through the ring hole 331 in the cable ring 33 for ensuring the reliable locking of the present invention especially as shown in FIGS. 1, 2.

The present invention further comprises a combination-changing means for re-setting or changing a new combination.

Figure 5:
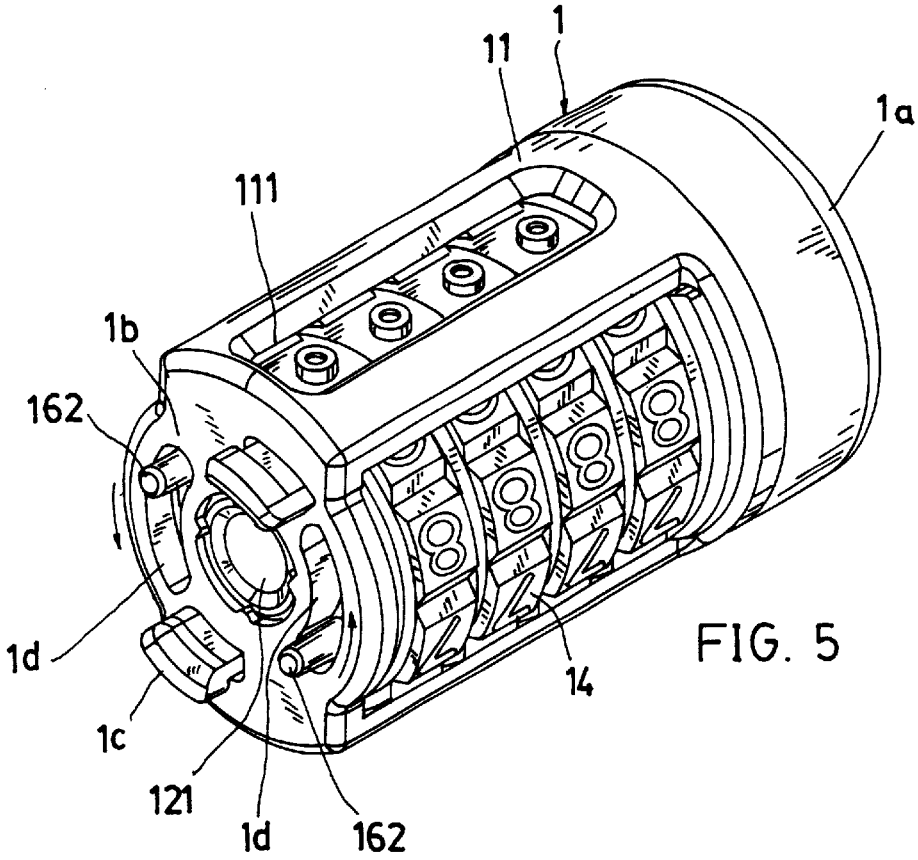
FIG. 5 is a partial perspective view of the lock body of the present invention.
Figure 6:
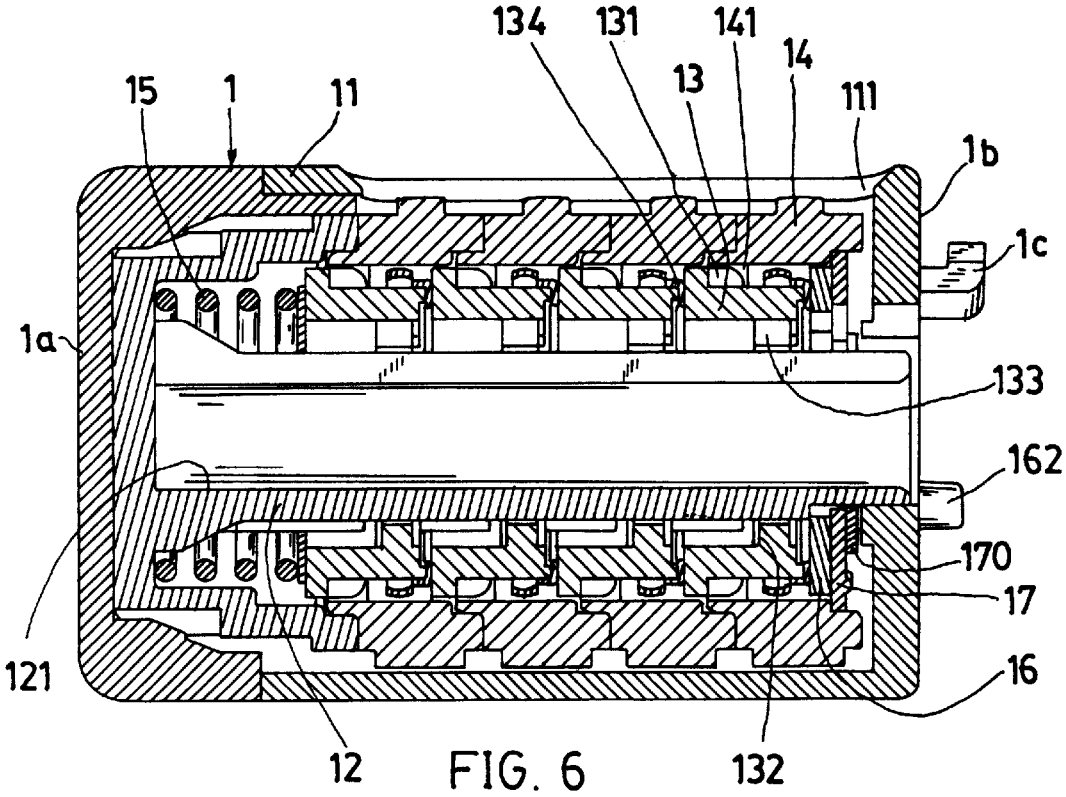
FIG. 6 is a sectional drawing of the lock body as shown in FIG. 5.
Figure 7:
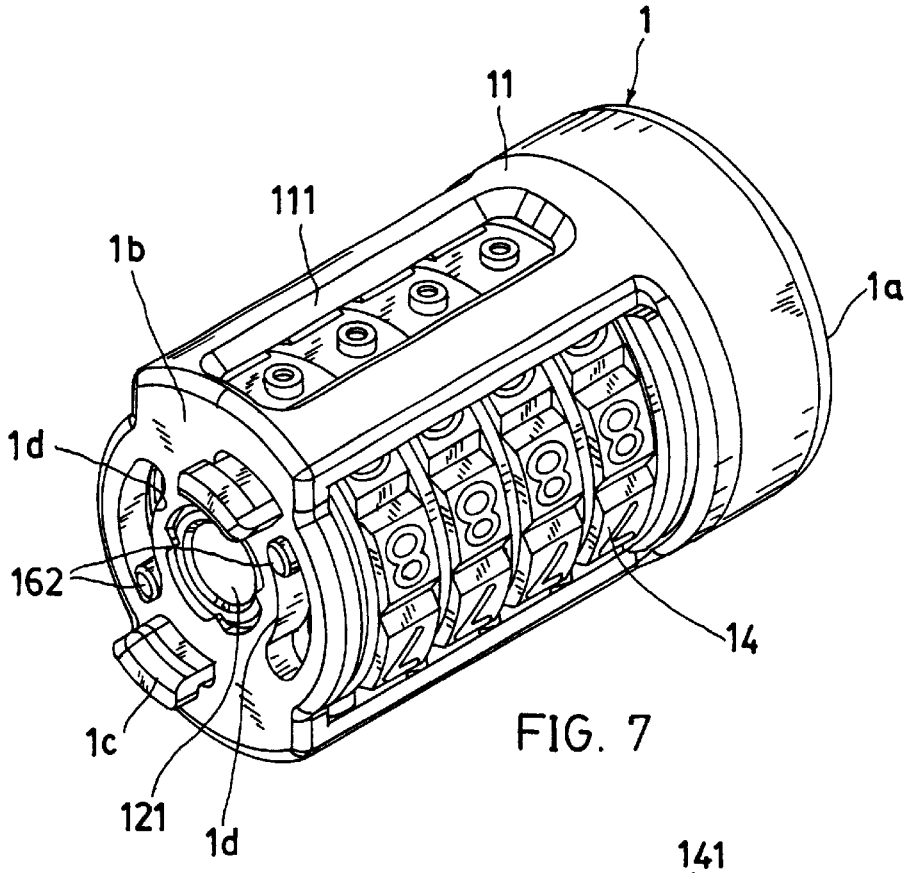
FIG. 7 is a perspective view when provided for changing combination from FIG. 5.
Figure 8:
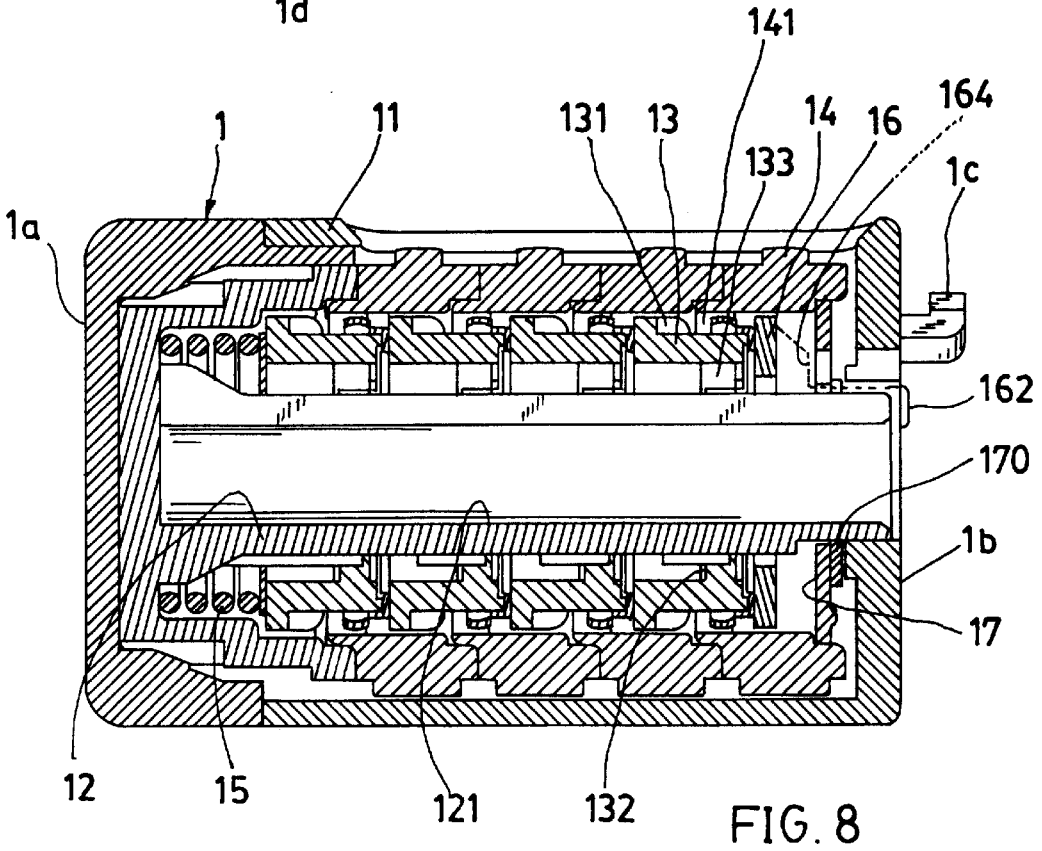
FIG. 8 is a sectional drawing of the lock body as shown in FIG. 7.
Figure 9:
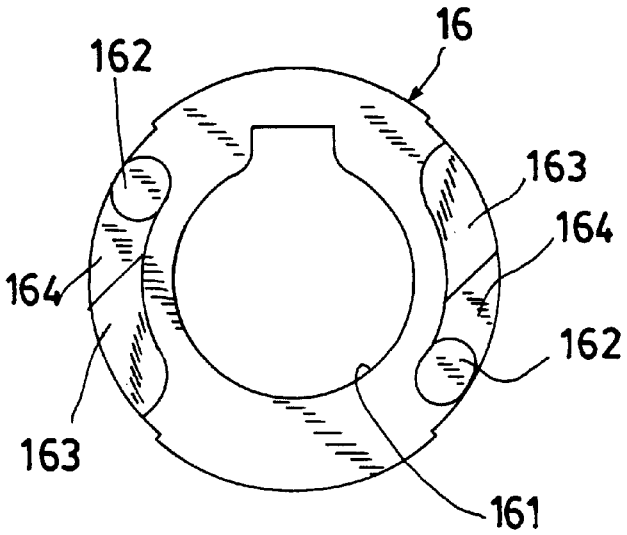
FIG. 9 is a front view of the thrusting disk of the combination-changing means of the present invention.
Figure 10:
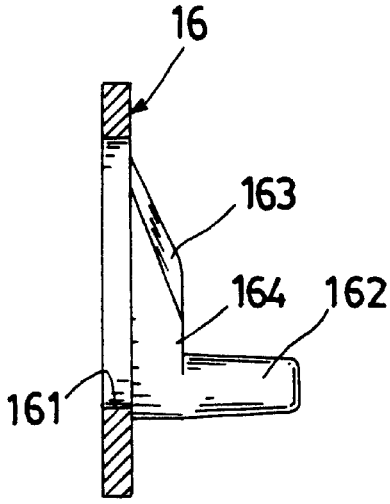
FIG. 10 is a sectional drawing of the thrusting disk as shown in FIG. 9.
Figure 11:
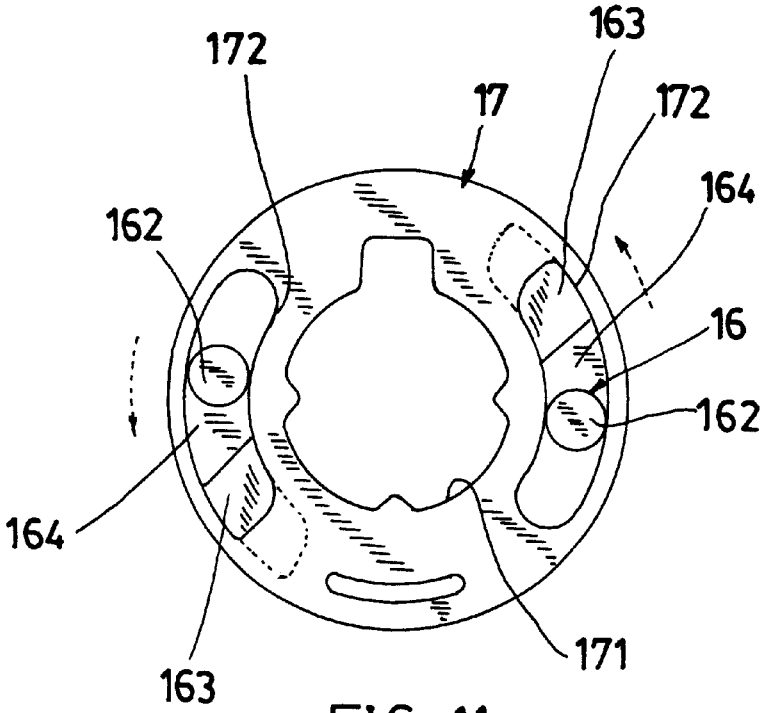
FIG. 11 shows a retaining plate engaged with the thrusting disk of the present invention.

The combination-changing means includes: a thrusting disk 16 held between the retaining plate 17 adjacent the free end plate 1*b* of the housing 11 and an outermost sleeve 13, with the retaining plate 17 secured on the hollow spindle 12 by a retainer 170; with the thrusting plate 16 including: a central opening 161 engaging with the hollow spindle 12, a pair of pushing rods 162 respectively formed on a pair of arcuate sloping portions 163 arcuately formed on opposite ridge portions 164 of the thrusting disk 16, each pushing rod 162 protruding outwardly through an arcuate guiding slot 172 with two arcuate guiding slots 172 respectively arcuately formed in opposite side portions of the retaining plate 17, and each rod 162 protruding outwardly through an outer arcuate guiding slot 1*d* with two outer arcuate guiding slots 1*d* respectively arcuately formed in opposite side portions of the free end plate 1*b* of the housing 11; whereby upon rotation of the thrusting disk 16 by biasing the two pushing rods 162 as shown in arrow directions of FIGS. 5 and 11, each sloping portion 163 of the thrusting disk 16 will be tangentially thrusted by an end wall of the arcuate guiding groove 172 of the retaining plate 17, thereby axially driving the sleeves 13 inwardly towards the bottom portion 1*a* of the housing 11 by overcoming the spring force of the tension spring 15 normally urging the sleeves 13 outwardly towards the free end plate 1*b* of the housing (as from FIGS. 5, 6 to FIGS. 7, 8), and therefore disengaging each sleeve 13 from each dial 14 allowing a free rotation of the dials 14 for resetting a new combination. The ridge portion 164 of the thrusting disk 16 is now stably retained against an inside wall of the retaining plate 17.

After completing the combination changing procedure, the two pushing rods 162 are rotated in a counter direction to allow each sloping portion 163 of the thrusting disk 16 to be retracted and protruded outwardly beyond the arcuate guiding slot 172 and the tension spring 15 will restore the sleeves 13 to re-engage with the dials 14 normally.

When using the present invention as shown in FIG. 1, the cable 3 is wound to form a loop around a rod L which may be a supporting leg, a column, a beam or any fixed member of a fixture F of a stable heavy furniture, installation or building; and then directed to pass through the aperture in the staple portion 42 of the fastener 4 fixed on the object P such as a computer to finally insert the locking bolt 2 into the lock body 1 through the cable ring 33 to lock the bolt 2 in the lock body 1, thereby safely locking the object P to a fixture F by the present invention.

As shown in dotted line of FIG. 1, the locking bolt 2 may be first led to pass through the ring 33 of the cable 3 to form a small loop 30 to be fastened on the fixed rod L of the fixture F and then the bolt 2 is directed to pass through the staple portion 42 of the fastener 4 to be finally locked in the lock body 1, thereby also locking the object P to the fixture F.

As shown in FIG. 2, a second fastener 42 is fixed on the fixture F and the cable 3 is directed to pass through the two fasteners 4 respectively secured on the computer P and on the fixture F to finally lock the bolt 2 with the lock body I for safely locking the computer P with the fixture F.

The cable 3 of the present invention may be continuously extended to pass through a plurality of fasteners 4 respectively fixed on plural equipments including computers, the related peripheral equipments or OA equipments to lock the plural equipments together to a safe fixture (not shown).

By simple dialing operation of the combination lock of the present invention, the present invention may be instantly served for locking or unlocking a portable equipment without further preparing a lock and a key for unlocking the lock.

The present invention therefore provides a simple and convenient locking device for locking the precious portable equipments to be superior to a conventional prior art.

The present invention may be modified without departing from the spirit and scope of this invention.

I claim:

1. A cable combination lock comprising;

a lock body (1) having a plurality of dials (14) and sleeves (13) rotatably mounted in said lock body (1);

a locking bolt (2) insertable and lockable in said lock body (1) by operating said dials (14) and sleeves (13) to a locking combination;

a cable (3) having a first cable end (31) secured with said locking bolt (2) and having a second cable end (32) formed with a cable ring (33); and at least a fastener (4) fixed on an object (P) to be locked; whereby upon direction of said locking bolt (2) and said cable (3) to pass through said fastener (4) of the object (P) and to pass said locking bolt (2) through said cable ring (33) to form a loop of said cable (3) around a fixture (F) to finally lock said locking bolt (2) in said lock body (1) to thereby lock the object (P) to said fixture (F).

2. A cable combination lock according to claim 1, wherein said lock further includes said fastener (4) secured on the fixture (F) to allow said cable (3) operatively passing through said fastener (4) secured on the fixture (F) for fastening said cable (3) on said fixture (F).

3. A cable combination lock according to claim 1, wherein said fastener (4) includes a base (41) fixed on an object or a fixture, and a staple portion (42) formed with the base (41), having a locking aperture formed through said staple portion (42) for passing said locking bolt (2) and said cable (3) through said aperture in said staple portion (42).

4. A cable combination lock according to claim 1, wherein said lock body (1) has a diameter or width larger than that of the cable ring (33) of said cable (3) and larger than that of a locking aperture formed in said fastener (4); and said locking bolt (2) having a diameter smaller than that of the cable ring (33) and smaller than that of said locking aperture in said fastener (4).

5. A cable combination lock according to claim 1, wherein said lock body (1) includes: a housing (11), a hollow spindle (12) protruding from a bottom portion (1*a*) of said housing (11) towards a free end plate (1*b*) of said housing (11) for rotatably mounting said dials (14) and said sleeves (13) on said spindle (12), a tension spring (15) resiliently urging said sleeves (13) from said bottom portion (1*a*) towards said free end plate (1*b*) for resiliently engaging said sleeves (13) with said dials (14), and a thrusting disk (16) held on a retaining plate (17)retained in the free end plate (1*b*) of said housing (11), with said thrusting disk (16) provided for a combination changing means.

6. A cable combination lock according to claim 5, wherein said housing (11) includes a display window (111) longitudinally formed in said housing (11) for reading a combination of said dials (14); and a pair of dialing windows (112) disposed on opposite sides of said housing (11) for rotating the dials (14) through said dialing windows (112).

7. A cable combination lock according to claim 5, wherein said spindle (12) is formed with a central hole for inserting therein said locking bolt (2), said locking bolt (2) including a plurality of projections (22) longitudinally formed on said bolt (2); each said projection (22) operatively engaging with an annular retarding ring (132) annularly formed in each said sleeve (13) for locking said bolt (2) in said lock body (1); and each said projection (22) operatively engaging with a notch (133) formed through said annular retarding ring (132) of said sleeve (13) for unlocking said bolt (2) from said lock body (1).

8. A cable combination lock according to claim 5, wherein said housing (11) further includes a cover (10) for covering said free end plate (1*b*) of said housing (11), said locking bolt (2) having an outer portion thereof formed as a handle portion (21) insertable and rotatably in said cover (10) on said housing (11).

9. A cable combination lock according to claim 1, wherein said lock further includes a plurality of fasteners (4), each said fastener (4) fixed on a portable object (P) to be locked to allow said cable (3) operatively respectively passing through said plurality of fasteners (4) respectively fixed on said portable objects for locking said objects by said cable (3).

10. A cable combination lock according to claim 5, wherein said thrusting disk (16) is formed as a combination-changing means, said thrusting disk (16) held between the retaining plate (17) adjacent the free end plate (1*b*) of the housing (11) and an outermost sleeve (13), with the retaining plate (17) secured on the hollow spindle (12); said thrusting plate (16) including: a central opening (161) engaging with the hollow spindle (12), a pair of pushing rods (162) respectively formed on a pair of arcuate sloping portions (163) arcuately formed on opposite ridge portions (164) of the thrusting disk (16), each said pushing rod (162) protruding outwardly through an arcuate guiding slot (172) with two said arcuate guiding slots (172) respectively arcuately formed in opposite side portions of the retaining plate (17), and each said pushing rod (162) protruding outwardly through an outer arcuate guiding slot (1*d*) with two said outer arcuate guiding slots (1*d*) respectively arcuately formed in opposite side portions of the free end plate (1*b*) of the housing (11); whereby upon rotation of the thrusting disk (16) by biasing the two pushing rods (162), each said sloping portion (163) of the thrusting disk (16) will be tangentially thrusted by an end wall of the arcuate guiding groove (172) of the retaining plate (17), thereby axially driving the sleeves (13) inwardly towards the bottom portion (1*a*) of the housing (11) for disengaging the sleeves (13) from the dials (14) for free rotation of the dials (14) for resetting a new combination.

* * * * *